United States Patent [19]

Feng

[11] Patent Number: 4,679,282

[45] Date of Patent: Jul. 14, 1987

[54] PRESS FASTENER

[76] Inventor: Lung S. Feng, 7F, No. 180, Lane 415, Kuang Fu S. Rd., Taipei, Taiwan

[21] Appl. No.: 870,541

[22] Filed: Jun. 4, 1986

[51] Int. Cl.[4] ..... A44B 11/25

[52] U.S. Cl. ..... 24/614; 24/171; 24/615

[58] Field of Search ..... 24/614, 615, 616, 665, 24/171, 194, 196; 2/6, 421, 427, 452

[56] References Cited

U.S. PATENT DOCUMENTS

| | | | |
|---|---|---|---|
| 1,701,970 | 2/1929 | Chaunard | 24/665 |
| 3,798,711 | 3/1974 | Cousins | 24/196 |
| 4,001,923 | 1/1977 | Frankel et al. | 24/665 |
| 4,035,877 | 7/1977 | Brownson et al. | 24/171 |
| 4,110,873 | 9/1978 | Verchere | 24/615 |
| 4,150,464 | 4/1979 | Tracy | 24/615 |
| 4,282,634 | 8/1981 | Krauss | 24/616 |
| 4,398,324 | 8/1983 | Bakker et al. | 24/615 |

FOREIGN PATENT DOCUMENTS

| | | | |
|---|---|---|---|
| 2451175 | 11/1980 | France | 24/616 |

*Primary Examiner*—Victor N. Sakran
*Attorney, Agent, or Firm*—Clifford A. Poff

[57] ABSTRACT

A press fastener comprising a plug body connecting with a slotted body. The plug body contains an elastic tongue part for extending into the slotted body. The tongue part contains a climbing angle positioned at the end thereof to hook the plug body to the slotted body when the climbing angle of the tongue part extends along an angled receiving groove of the slotted body, thereby stressing the tongue part, and into a center cavity of the slotted body. The central cavity is of such dimensions to allow a press groove to be supported therein to allow unhooking of the plug body from the slotted body when pressure is exerted thereon.

3 Claims, 2 Drawing Figures

PRESS FASTENER

BACKGROUND OF THE INVENTION

1. Field of the Invention:

The present invention relates generally to fastening devices, and more particularly, a press fastener.

2. Description of the Prior Art:

Conventional fasteners, such as are known in the art, are generally composed of two parts. A first part, a plug body connects with a second part, a slotted body containing a grooved-wall along the internal slot thereof. The parts are fastened by plugging the plug body into the internal slot of the slotted body.

However, fasteners of the prior art suffer from several inherent defects which limit the utility of such fasteners. First, two-part fasteners obtain the clasping effect required to fasten the two sides theretogether through contact between the inner surfaces of the slotted body and the surfaces of the elastic tongue part. At times, this contact is not tight, providing only a loose connection and therefore limiting the clasping ability of the fastener.

Secondly, the durability of many fasteners known in the prior art is inadequate for frequent use; sometimes the fastener breaks after use of only several times.

Thirdly, because the internal walls of the slotted body must be grooved, production costs to produce slotted bodies with the required groove is high.

It is, therefore, the object of the present invention to provide a press fastener which overcomes the above-listed inadequacies inherent in press fasteners of the prior art.

SUMMARY OF THE PRESENT INVENTION

In accordance with the present invention, a press fastener including the combination of a plug body, a slotted body and an elastic press part. The press fastener includes an outwardly extending elastic tongue positioned at one end of the plug body with the tongue part containing a climbing angle peak along a front portion thereof. The slotted body includes an angled receiving groove extending interiorly from one end of said slotted body to a press groove creating a gap in a central portion thereof, to thereby allow the elastic tongue part to extend through the receiving groove of the slotted body such that the climbing angle peak of the tongue part extends into the press groove of the slotted body to thereby fasten the plug body to the slotted body. The elastic press part is positioned in the press groove and supported therein to allow a downward pressure to be exerted on the climbing angle of the tongue part to thereby unfasten the plug body from the slotted body.

BRIEF DESCRIPTION OF THE DRAWINGS

The invention may be better understood and further advantages and uses thereof more readily apparent when considered in view of the following detailed description of exemplary embodiments taken with the accompanying drawings in which.

DESCRIPTION OF THE PREFERRED EMBODIMENT

Figure 1:
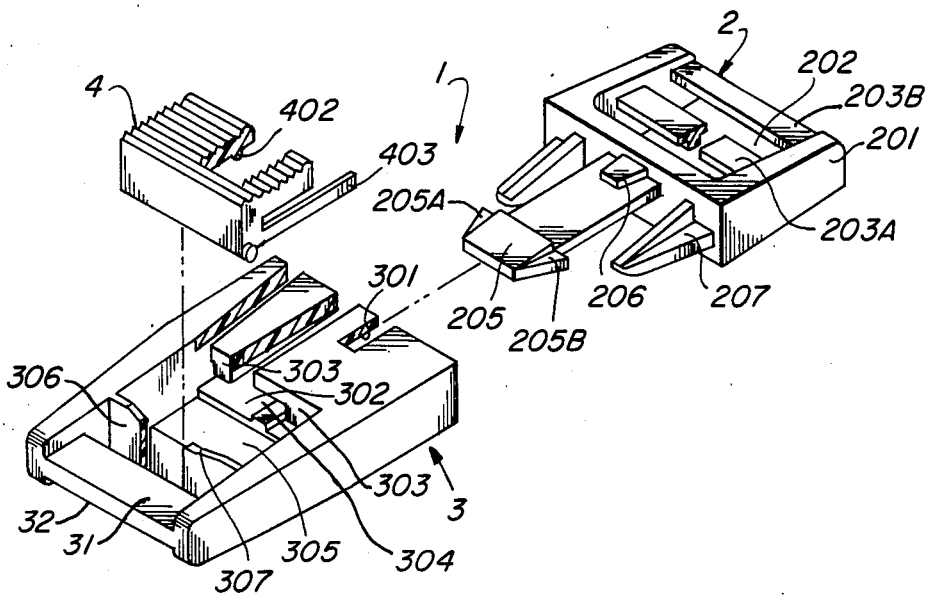
FIG. 1 is a perspective view in section of the press fastener of the present invention.

Referring now to the illustration of FIG. 1, there is shown the press fastener of the present invention referred to generally as 1. The fastener 1 includes a plug body 2 and a slotted body 3.

The plug body 2 is comprised of a generally rectangular upper plate 201. Protruding bars 203A and 203B span the gap between the two opposing arms of the upper plate 201, thereby forming a groove 202. The groove 202 functions to allow a belt, for example, to pass therethrough to wrap around the bar 203 to thereby affix the belt to the plug bar 2. Protruding outwardly from one side of the base portion of U-shaped plate 201 is an elastic tongue 204. Elastic tongue 204 contains, at the end thereof, a trapezoidal front portion with sides 205A and 205B defined by a climbing angle 205 extending along the face of the tongue 204 therebetween. Trapezoidal protruding bar 206 positioned directly above tongue 204 also protrudes outwardly from the base portion of the plate 201. Further protruding from the base portion of plate 201 are two slanting bars 207 which extend outwardly from the opposite ends of the base portion of the bar 201, each equidistant from the tongue 204. The upper surfaces of each of the slanting bars 207 form an inclined plane.

The slotted body 3 contains a receiving groove 302 extending interiorly from one side of the slotted body 3. An upper interior surface of groove 302 contains two angled slanting walls 303 extending in the lengthwise direction of the groove 302. The separation distance between the two slanting walls 303 is that of the length of the climbing angle 205 of the tongue 204. The slanting walls 303 define a slideway 304 along the receiving groove and function to guide the climbing angle 205, and therefore, the tongue along the slideway 304 of the receiving groove. During this process, the tongue 204 is stressed as it is bent to conform to the slideway 304 defined by the angled slanting walls 303. The receiving groove 302 terminates at a center cavity, referred to as press groove 305. At this termination point, the climbing angle 205 of the elastic tongue 204 which has been bent to conform to the path of the slideway 304 hooks up with the front wall of the receiving groove as defined by the termination point of the receiving groove 302. Similar to the groove 202 defined by bar 21 of plug body 2, slotted body 3 contains opening 31 defined by bar 32 to allow a second end of a belt, for example, to pass therethough.

An elastic press body 4 of dimensions allowing placement in press groove 305 and received therein includes a protruded body 402 at a bottom portion thereof. Two outwardly projecting extenders 403 extend out from the press body 4 and into receiving groove 302, and function as positioners to maintain the orientation of the elastic press body in the press groove 305 to retain press body 4 in an operative position. When climbing angle 205 of tongue 204 is hooked in position at the termination of the receiving groove 302, the press groove 305 functions to, through the protruded body 402, to press the peak climbing angle 205 of the tongue 204, to thereby unhook the climbing angle 205 of tongue 204, to allow release of the plug body 2 from the slotted body 3. Because the elastic tongue 204 is stressed, an outward component of force aids in the separation of the plug body 2 from the slotted body 3. Damper 306 defining the back wall of press groove 305 contains an arcked roof 307 to aid one in applying a downward force on the press body 4.

Figure 2:
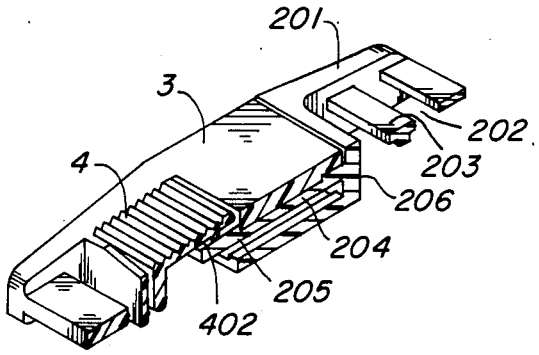
FIG. 2 is a cross-sectional view of the press fastener of FIG. 1 in which the two parts of the press fastener of FIG. 1 are in the fastened position.

Shown in the cross-sectional view of FIG. 2 is a view of the press fastener 1 in the closed position. Shown is the climbing angle 205 of the tongue 204 positioned behind the termination point of the receiving groove 305. By exerting pressure on the press body 4, the protruded body 402 presses down against the climbing angle 205 to thereby unhook the climbing angle 205 of tongue 204 from the termination point of the receiving groove 305.

While the present invention has been described in connection with the preferred embodiment shown in FIGS. 1 and 2, it is understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim as my invention:

1. A press fastener, including the combination of:

a plug body including outwardly extending elastic tongue part positioned at one end of said plug body, said tongue part containing a climbing angle peak along a front portion thereof;

a slotted body including an angled receiving groove extending interiorly from one end of said slotted body to a press groove creating a gap in a central portion thereof for allowing said elastic tongue part to extend through said receiving groove such that said climbing angle peak of the tongue part extends into said press groove to fasten said plug body to said slotted body; and an elastic press body positioned in the press groove of said slotted body supported thereby for allowing downward pressure exerted upon said elastic press body to be transmitted to said climbing angle of the elastic tongue part to thereby unfasten said plug body from said slotted body.

2. The press fastener of claim 1 further including outwardly extending extenders attached to said elastic press body extending into said slotted body to maintain the orientation of said elastic press body in the elastic press groove.

3. The press fastener of claim 1 further including slanting bars protruding from said plug body in directions parallel to the lengthwise direction of the elastic tongue part for insertion into said slotted body.

* * * * *